US009796023B2

(12) United States Patent
Rowe et al.

(10) Patent No.: US 9,796,023 B2
(45) **Date of Patent: *Oct. 24, 2017**

(54) SYNTHESIS OF FERROMAGNETIC MANGANESE-BISMUTH NANOPARTICLES USING A MANGANESE-BASED LIGATED ANIONIC-ELEMENT REAGENT COMPLEX (MN-LAERC) AND FORMATION OF BULK MNBI MAGNETS THEREFROM

(71) Applicants: Toyota Motor Engineering & Manufacturing North America, Inc., Erlanger, KY (US); The University of Manitoba, Winnipeg (CA)

(72) Inventors: Michael Paul Rowe, Pinckney, MI (US); Elizabeth Marie Skoropata, Winnipeg (CA); Yaroslav Stephan Wrocyznskyj, Winnipeg (CA); Johan Alexander van Lierop, Winnipeg (CA)

(73) Assignees: Toyota Motor Engineering & Manufacturing North America, Inc., Erlanger, KY (US); The University of Manitoba, Winnipeg, Manitoba (CA)

( * ) Notice: Subject to any disclaimer, the term of this patent is extended or adjusted under 35 U.S.C. 154(b) by 350 days.

This patent is subject to a terminal disclaimer.

(21) Appl. No.: 14/593,583

(22) Filed: Jan. 9, 2015

(65) Prior Publication Data

US 2016/0199916 A1 Jul. 14, 2016

(51) Int. Cl.
*B22F 3/14* (2006.01)
*B22F 9/24* (2006.01)
(Continued)

(52) U.S. Cl.
CPC ..... *B22F 9/18* (2013.01); *B22F 1/0003* (2013.01); *C22C 12/00* (2013.01); *H01F 1/0045* (2013.01);
(Continued)

(58) Field of Classification Search
None
See application file for complete search history.

(56) References Cited

U.S. PATENT DOCUMENTS 8,361,651 B2 1/2013 Matsui
8,980,219 B1 3/2015 Rowe et al.
(Continued)

FOREIGN PATENT DOCUMENTS

CN 102909381 A 6/2013
DE 112012001928 T5 2/2014
(Continued)

OTHER PUBLICATIONS

Harris, "X. Quantitative Measurement of Preferred Orientation in Rolled Uranium Bars", Sep. 1951, pp. 113-123, pp. 113-123 Ser. 7, vol. 43, No. 336.

(Continued)

*Primary Examiner* — George Wyszomierski
(74) *Attorney, Agent, or Firm* — Christopher G. Darrow; Darrow Mustafa PC

(57) ABSTRACT

A method for synthesizing ferromagnetic manganese-bismuth (MnBi) nanoparticles, and the MnBi nanoparticles so synthesized, are provided. The method makes use of a novel reagent termed a manganese-based Anionic Element Reagent Complex (Mn-LAERC). A process for forming a bulk MnBi magnet from the synthesized MnBi nanoparticles is also provided. The process involves simultaneous application of elevated temperature and pressure to the nanoparticles.

11 Claims, 2 Drawing Sheets

(51) Int. Cl.

| | |
|---|---|
| ***B22F 9/18*** | (2006.01) |
| ***B22F 1/00*** | (2006.01) |
| ***C22C 12/00*** | (2006.01) |
| ***H01F 1/01*** | (2006.01) |
| ***H01F 41/02*** | (2006.01) |
| ***H01F 1/00*** | (2006.01) |
| ***H01F 1/08*** | (2006.01) |
| *C22C 1/04* | (2006.01) |

(52) U.S. Cl.

CPC ..... *H01F 1/01* (2013.01); *H01F 1/086* (2013.01); *H01F 41/02* (2013.01); *B22F 1/0018* (2013.01); *B22F 3/14* (2013.01); *B22F 9/24* (2013.01); *C22C 1/0491* (2013.01); *C22C 2202/02* (2013.01)

(56) References Cited

U.S. PATENT DOCUMENTS

| | | | | |
|---|---|---|---|---|
| 9,142,834 | B2 | 9/2015 | Mohtadi et al. | |
| 9,278,392 | B2 * | 3/2016 | Rowe et al. | B22F 9/24 |
| 2009/0029206 | A1 | 1/2009 | Jung et al. | |
| 2012/0235077 | A1 * | 9/2012 | Iftime et al. | H01F 1/24 252/62.54 |
| 2013/0084502 | A1 | 4/2013 | Singh et al. | |
| 2014/0132376 | A1 * | 5/2014 | Jin | H01F 1/01 335/302 |
| 2015/0068646 | A1 | 3/2015 | Rowe | |
| 2015/0097649 | A1 | 4/2015 | Rowe | |
| 2015/0098882 | A1 | 4/2015 | Rowe | |
| 2015/0098884 | A1 | 4/2015 | Rowe | |
| 2015/0098885 | A1 | 4/2015 | Rowe | |
| 2015/0098886 | A1 | 4/2015 | Rowe et al. | |
| 2015/0098892 | A1 | 4/2015 | Rowe et al. | |
| 2016/0035487 | A1 * | 2/2016 | Kim et al. | H01F 41/0266 |
| 2016/0200753 | A1 | 7/2016 | Rowe et al. | |

FOREIGN PATENT DOCUMENTS

| | | | |
|---|---|---|---|
| JP | 2006152376 | A | 6/2006 |
| WO | 2011150212 | A2 | 12/2011 |
| WO | 2013056185 | A1 | 4/2013 |

OTHER PUBLICATIONS

Imamura et al., "Dehydriding of Sn/MgH2 nanocomposite formed by ball milling of MgH2 with Sn", International Journal of Hydrogen Energy, Jul. 2007, pp. 4191-4194, vol. 32.

Schüth et al., "Light Metal Hydrides and Complex Hydrides for Hydrogen Storage", Chem Commun, Sep. 2004, pp. 2249-2258, Issue 20.

Suzuki et al. "Spin Reorientation Transition and Hard Magnetic Properties of MnBi Intermetallic Compound", Feb. 2012, J. Appl. Phys., pp. 07E303-1-07E303-3, vol. 111.

Varin et al., "The Effects of Ball Milling and Nonmetric Nickel Additive on the Hydrogen Desorption from Lithium Borohydride and Manganese Chloride (3LiBH4+MnCl2) Mixture", 2010, Int. J. Hydrogen Energy, pp. 3588-3597, vol. 35.

Wronski et al., "A New Nanonickel Catalyst for Hydrogen Storage in Solid-state Magnesium Hydrides", 2011, Int. J. Hydrogen Energy, vol. 36, pp. 1159-1166.

Yang et al. "Anisotropic Nanocrystalline MnBi with High Coercivity at High Temperature", Aug. 2011, Appl. Phys. Lett., vol. 99, Article No. 082505, 4 pages.

Yang et al. "Temperature Dependences of Structure and Coercivity for Melt-spun MnBi Compound", Nov. 2012, J. Magnetism Magnet. Mat., pp. 106-110, vol. 330.

Rowe et al., "Synthesis of Metal Nanoparticles", U.S. Appl. No. 14/046,120, filed Oct. 4, 2013.

Poudyal et al.; "Advances in nanostructured permanent magnets research"; Journal of Physics D: Applied Physics; Dec. 14, 2012; in 11 pages; vol. 46; No. 4.

Rowe et al., "Ligated Anionic-Element Reagent Complexes (LAERCs) as Novel Reagents", U.S. Appl. No. 14/593,371, filed Jan. 9, 2015.

* cited by examiner

SYNTHESIS OF FERROMAGNETIC MANGANESE-BISMUTH NANOPARTICLES USING A MANGANESE-BASED LIGATED ANIONIC-ELEMENT REAGENT COMPLEX (MN-LAERC) AND FORMATION OF BULK MNBI MAGNETS THEREFROM

TECHNICAL FIELD

The present invention relates in general to methods for synthesizing alloyed, ferromagnetic metal nanoparticles and processes for forming bulk magnets from the synthesized nanoparticles.

BACKGROUND

Ferromagnetic materials, materials with a strong tendency to align atomic magnetic dipoles with strict parallelism, are indispensable to the operation of a wide array of retail and industrial devices. Such materials are strongly responsive to applied magnetic fields and can also be prepared to emanate stable, bulk magnetic fields themselves. As examples of applications, a wide array of electronic devices such as medical and scientific diagnostic devices, electronic data storage media, and electronic or electromagnetic beam-steering devices rely on ferromagnetic materials to function. Of particular interest are core-solenoid devices having ferromagnetic cores, such as electric motors and electric generators.

Conventionally, ferromagnetic materials are alloys or compositions consisting primarily of the inherently ferromagnetic elements such as iron, nickel, cobalt, as well as certain compositions of rare-earth metals. Because of the relatively high density of these elements, typically about 8 $g/cm^3$ or 500 $lb/ft^3$, devices which employ an appreciable amount of ferromagnetic material tend to be very heavy.

Automotive vehicles use ferromagnetic materials in a variety of ways, particularly in core-solenoid devices. These range from the relatively small, such as an alternator or an electric motor that operates a power window, to the relatively large, such as in the drive train of a hybrid vehicle or all-electric vehicle. The development of ferromagnetic (including ferrimagnetic) materials or compositions having much lower density than that of the inherently ferromagnetic elements can potentially decrease the weight and thereby improve the efficiency of such vehicles.

Previous disclosures have shown the preparation of magnetic nanoparticles, such as MnBi nanoparticles, using a family of novel reagent complexes. The preparation of bulk magnets from magnetic nanoparticles typically involves a step of binding, fusing, sintering, or otherwise attaching the individual nanoparticles to one another into a bulk composition. The particular process by which this is achieved can affect the magnetic properties of the bulk magnet. Methods for making a bulk magnet from magnetic nanoparticles which enhance the magnetic properties of the bulk magnet are to be desired.

SUMMARY

The present technology generally provides a method for synthesizing ferromagnetic MnBi nanoparticles, the nanoparticles so synthesized, and a process for forming a bulk MnBi magnet from the nanoparticles.

In one aspect, a method for synthesizing MnBi nanoparticles is disclosed. The method comprises adding cationic bismuth to a complex according to Formula I:

$$Mn^0.X_y.L_z \qquad \text{I,}$$

wherein $Q^0$ is zero-valent manganese, X is a hydride molecule, L is a nitrile compound, y is an integral or fractional value greater than zero, and z is an integral or fractional value greater than zero. In some particular instances, the hydride molecule is lithium borohydride, the nitrile compound is undecyl cyanide, or both.

The present teachings additionally disclose the MnBi nanoparticles synthesized by the previously mentioned method.

In yet another aspect, a process for forming bulk MnBi magnets from MnBi nanoparticles is disclosed. The process includes a step of simultaneously applying elevated heat and elevated pressure to a sample of MnBi nanoparticles. The MnBi nanoparticles are prepared by a method comprising a step of adding cationic bismuth to a complex according to Formula I:

$$Mn^0.X_y.L_z \qquad \text{I,}$$

wherein $Q^0$ is zero-valent manganese, X is a hydride molecule, L is a nitrile compound, y is an integral or fractional value greater than zero, and z is an integral or fractional value greater than zero. In some particular instances, the hydride molecule is lithium borohydride, the nitrile compound is undecyl cyanide, or both.

BRIEF DESCRIPTION OF THE DRAWINGS

Various aspects and advantages of the invention will become apparent and more readily appreciated from the following description of the embodiments taken in conjunction with the accompanying drawings, of which.

DETAILED DESCRIPTION

Figure 1:
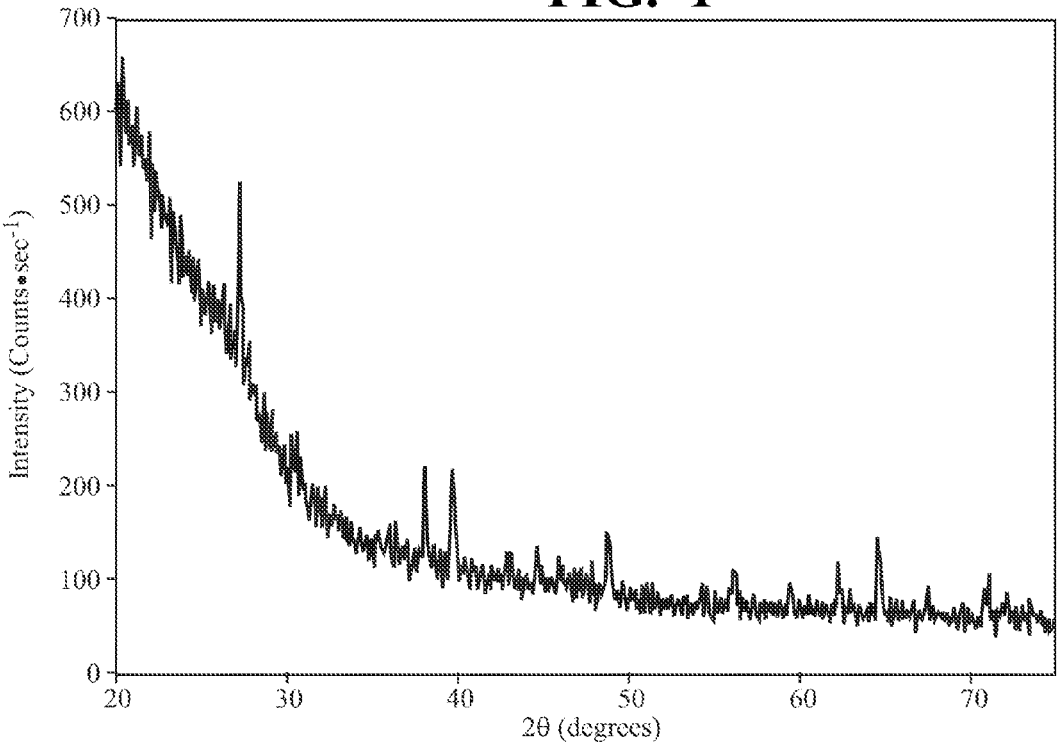
FIG. 1 is a graph of x-ray diffraction intensity for a sample of MnBi nanoparticles synthesized by a disclosed method.

The present disclosure describes a method for synthesizing MnBi nanoparticles, the MnBi nanoparticles so synthesized, and a process for forming bulk MnBi magnets from the synthesized MnBi nanoparticles.

The method is facile and reproducible, the resulting nanoparticles have desirable ferromagnetic properties, and those properties are enhanced in the bulk magnet.

One method for synthesizing MnBi nanoparticles utilizes a novel reagent termed Mn-LAERC (manganese-based Ligated Anionic Element Reagent) disclosed in the co-pending U.S. patent application Ser. No. 14/593,371 which is incorporated herein in its entirety. The method quickly and reproducibly generates ferromagnetic nanoparticles of low-temperature phase (LTP) MnBi having coercivity that can exceed 500 Oe. The process for forming a bulk MnBi magnet from the nanoparticles quickly and reproducibly generates a magnet having coercivity that can exceed 0.5 kOe at ambient temperature, for example 25° C.

Thus, a method is disclosed for synthesizing MnBi nanoparticles. The method includes a step of adding cationic bismuth to a complex according to Formula I:

$$Mn^0.X_y.L_z \quad \text{I,}$$

wherein $Mn^0$ is zero-valent manganese, X is a hydride molecule, L is a nitrile compound, y is an integral or fractional value greater than zero, and z is an integral or fractional value greater than zero.

The complex according to Formula I will alternatively be referred to as a "manganese-based Ligated Anionic Element Reagent Complex", or Mn-LAERC. As used herein, the phrase "zero-valent manganese" refers to elemental manganese, alternatively described as manganese metal that is in oxidation state zero.

As used herein, the interchangeable term "hydride molecule" refers generally to any molecular species capable of functioning as a hydrogen anion donor. In different instances, a hydride molecule as referenced herein can be a binary metal hydride or "salt hydride" (e.g. NaH, or $MgH_2$), a binary metalloid hydride (e.g. $BH_3$), a complex metal hydride (e.g. $LiAlH_4$), or a complex metalloid hydride (e.g. $LiBH_4$ or $Li(CH_3CH_2)_3BH$). In some examples the hydride molecule will be $LiBH_4$. The term hydride molecule as described above can in some variations include a corresponding deuteride or tritide.

The phrase "nitrile compound", as used herein, refers to a molecule having the formula R—CN. In different implementations, R can be a substituted or unsubstituted alkyl or aryl group, including but not limited to: a straight-chain, branched, or cyclic alkyl or alkoxy; or a monocyclic or multicyclic aryl or heteroaryl. In some implementations, the R group of a nitrile compound will be a straight chain alkyl. In one particular implementation, the nitrile compound will be $CH_3(CH_2)_{10}CN$, alternatively referred to as dodecane nitrile or undecyl cyanide.

The value y according to Formula I defines the stoichiometry of hydride molecules to zero-valent manganese atoms in the complex. The value of y can include any integral or fractional value greater than zero. In some instances, 1:1 stoichiometry wherein y equals 1 may be useful. In other instances, a molar excess of hydride molecules to zero-valent manganese atoms, for example where y equals 2 or 4 may be preferred. A molar excess of hydride to zero-valent manganese can, in some instances, ensure that there is sufficient hydride present for subsequent applications. In some specific examples, y can be equal to 3.

The value z according to Formula I defines the stoichiometry of nitrile compound to zero-valent manganese atoms in the complex. The value of z can include any integral or fractional value greater than zero. In some instances, 1:1 stoichiometry wherein y equals 1 may be useful. In other instances, a molar excess of nitrile compound to zero-valent manganese atoms, for example where z equals 2 or 4 may be preferred. In some specific examples, z can be equal to 3.

The complexes of the present disclosure can have any supramolecular structure, or no supramolecular structure. Without being bound to any particular structure, and without limitation, the complex could exist as a supramolecular cluster of many zero-valent manganese atoms interspersed with hydride molecules and or nitrile compound. The complex could exist as a cluster of zero-valent manganese atoms in which the cluster is surface-coated with hydride molecules and/or nitrile compound. The complex could exist as individual zero-valent manganese atoms having little to no molecular association with one another, but each being associated with hydride molecules and nitrile compound according to Formula I. Any of these microscopic structures, or any other consistent with Formula I, is intended to be within the scope of the present disclosure.

In some variations of the method for synthesizing MnBi nanoparticles, the complex can be in solvated or suspended contact with a first solvent, the cationic bismuth can be in solvated or suspended contact with a second solvent, or both. In variations in which the complex is in solvated or suspended contact with a first solvent and the cationic bismuth is in solvated or suspended contact with a second solvent, the first and second solvents can either be the same or different solvents. When present, the first solvent can typically be a solvent that is non-reactive to the hydride molecule present in the complex, and when present, the second solvent can typically be a solvent in which the hydride molecule present in the complex is substantially soluble.

Non-limiting examples of suitable solvents that can serve as the first solvent, the second solvent, or both, include acetone, acetonitrile, benzene, 1-butanol, 2-butanol, 2-butanone, t-butyl alcohol, carbon tetrachloride, chlorobenzene, chloroform, cyclohexane, 1,2-dichloroethane, diethyl ether, diethylene glycol, diglyme (diethylene glycol, dimethyl ether), 1,2-dimethoxy-ethane (glyme, DME), dimethylether, dimethyl-formamide (DMF), dimethyl sulfoxide (DMSO), dioxane, ethanol, ethyl acetate, ethylene glycol, glycerin, heptane, Hexamethylphosphoramide (HMPA), Hexamethylphosphorous triamide (HMPT), hexane, methanol, methyl t-butyl ether (MTBE), methylene chloride, N-methyl-2-pyrrolidinone (NMP), nitromethane, pentane, Petroleum ether (ligroine), 1-propanol, 2-propanol, pyridine, tetrahydrofuran (THF), toluene, triethyl amine, o-xylene, m-xylene, or p-xylene.

In some particular examples, toluene is employed as a first solvent and a second solvent.

In some variations, the method for synthesizing MnBi nanoparticles can include a step of contacting the complex according to Formula I with a free surfactant. In variations which include the step of contacting the complex according to Formula I with a free surfactant, the contacting step can be performed prior to, simultaneous to, or subsequent to the step of adding cationic bismuth.

Without being bound by any particular mechanism, it is believed that upon addition of cationic bismuth to the complex (Mn-LAERC), the hydride molecule incorporated into the complex can reduce the cationic bismuth to elemental bismuth which then alloys with the manganese. In some aspects of the method for synthesizing MnBi nanoparticles, it may be desirable to ensure that sufficient equivalents of hydride molecule are present in the reagent complex to reduce the added cationic bismuth to oxidation state zero. In some instances it may be desirable to add additional equivalents of the hydride molecule to the reagent complex, either prior or simultaneous to addition of the cationic bismuth.

When used, a free surfactant employed in the method for synthesizing MnBi nanoparticles can be any known in the art. Non-limiting examples of suitable free surfactants can include nonionic, cationic, anionic, amphoteric, zwitterionic, polymeric surfactants and combinations thereof. Such surfactants typically have a lipophilic moiety that is hydrocarbon based, organosilane based, or fluorocarbon based. Without implying limitation, examples of types of surfactants which can be suitable include alkyl sulfates and sulfonates, petroleum and lignin sulfonates, phosphate esters, sulfosuccinate esters, carboxylates, alcohols, ethoxylated alcohols and alkylphenols, fatty acid esters, ethoxylated acids, alkanolamides, ethoxylated amines, amine oxides, nitriles, alkyl amines, quaternary ammonium salts, carboxybetaines, sulfobetaines, or polymeric surfactants. In some variations, the bismuth cation can be present as part of a bismuth salt having an anionic surfactant, such as an acyl anion. A non-limiting example of a bismuth salt in such a variation is bismuth neodecanoate.

In some instances in which a free surfactant is used, the free surfactant will be one capable of oxidizing, protonating, or otherwise covalently, datively, or ionically modifying the hydride molecule incorporated in the complex.

In some variations, the method for synthesizing MnBi nanoparticles can be performed under an anhydrous environment, under an oxygen-free environment, or under an environment that is anhydrous and oxygen-free. For example, the method for synthesizing MnBi nanoparticles can be performed under argon gas or under vacuum.

Also disclosed are the MnBi nanoparticles, nanoparticles composed substantially of alloyed manganese and bismuth, made by the method for synthesizing MnBi nanoparticles described above. FIG. 1 shows a graph of x-ray diffraction (XRD) intensity for MnBi nanoparticles of the present disclosure, identifying the nanoparticles as being formed of alloyed MnBi. The MnBi nanoparticles of FIG. 1 were prepared by adding bismuth neodecanoate, which can be considered to include both cationic bismuth and free surfactant, to a ligated anionic manganese complex, $Mn^0.Li(BH_4)_3.[CH_3(CH_2)_{10}CH]_3$.

Figure 2:
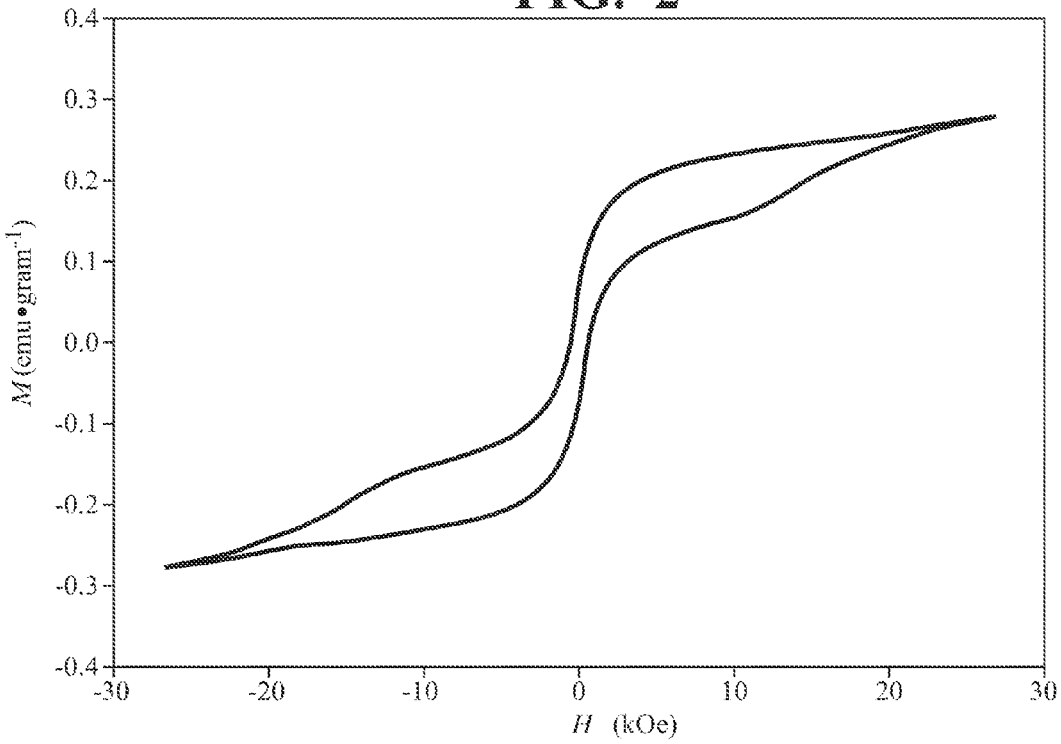
FIG. 2 is a magnetic hysteresis loop for the MnBi nanoparticles of FIG. 1.

In some implementations, the MnBi nanoparticles of the present disclosure will include low temperature phase (LTP) MnBi, the only crystallite structure of MnBi showing ferromagnetic properties. FIG. 2 shows a ferromagnetic hysteresis loop of the MnBi nanoparticles of FIG. 1, confirming that the nanoparticles include LTP MnBi.

Additionally disclosed is a process for forming a bulk MnBi magnet from the disclosed MnBi nanoparticles prepared by the disclosed method for synthesizing MnBi nanoparticles. The process for forming a bulk MnBi magnet includes a step of applying elevated heat and elevated pressure simultaneously to a sample of MnBi nanoparticles made by the method for synthesizing MnBi nanoparticles. As used herein, the phrase "elevated temperature" can refer to a temperature within the range 100-600° C. In some instances, the phrase "elevated temperature" can refer to a temperature within the range 100-200° C. As used herein, the phrase "elevated pressure" can refer to a pressure within the range 10-1000 MPa. In some instances, the phrase "elevated pressure" can refer to a pressure within the range 10-100 MPa. In some particular instances, the elevated pressure can be 40 MPa. In some variations, the elevated temperature can be 150° C.

In general, the step of applying elevated temperature and pressure will be performed for a duration of time. In some particular variations, the duration of time can be any non-zero duration up to 12 hours. In yet more particular variations, the duration of time can be within a range of 4-6 hours.

Figure 3:
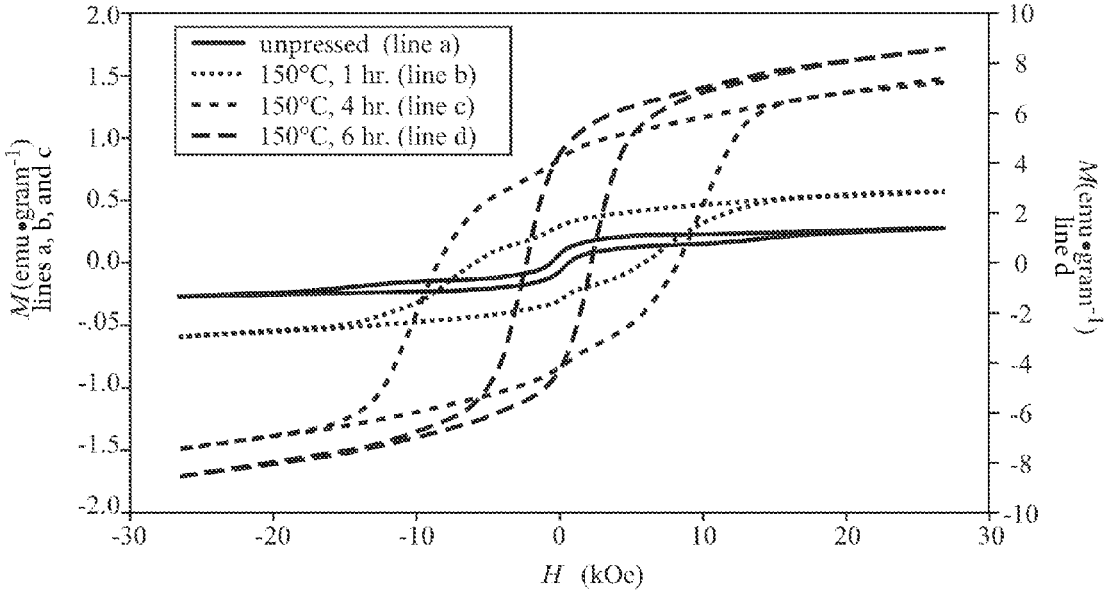
FIG. 3 is a series of magnetic hysteresis loops for samples including the MnBi nanoparticles of FIGS. 1 and 2 and bulk MnBi magnets formed by a disclosed process under varying conditions.

FIG. 3 shows the ferromagnetic hysteresis curve of the "unpressed" nanoparticles of FIGS. 1 and 2 overlaid with ferromagnetic hysteresis curves of three bulk magnets prepared by the disclosed process for making a bulk MnBi magnet. The three bulk magnets were derived from samples of MnBi nanoparticles upon which the applying step was performed at 40 MPa and 150° C. for 1, 4, or 5 hours. As can be seen from FIG. 3, when the duration of simultaneously applying 40 MPa elevated pressure and 150° C. elevated temperature is increased from zero, to one, to four hours, both coercivity and saturation of the sample increase. In particular, coercivities of the samples increase from about 0.6 to 6.0 to 8.4 kOe (kiloOersted). Upon the increase from 4 hours to 6 hours of applying the elevated temperature and elevated pressure in the example, saturation increases over 10-fold, but coercivity decreases from about 8.4 to 2.3 kOe.

Figure 4:
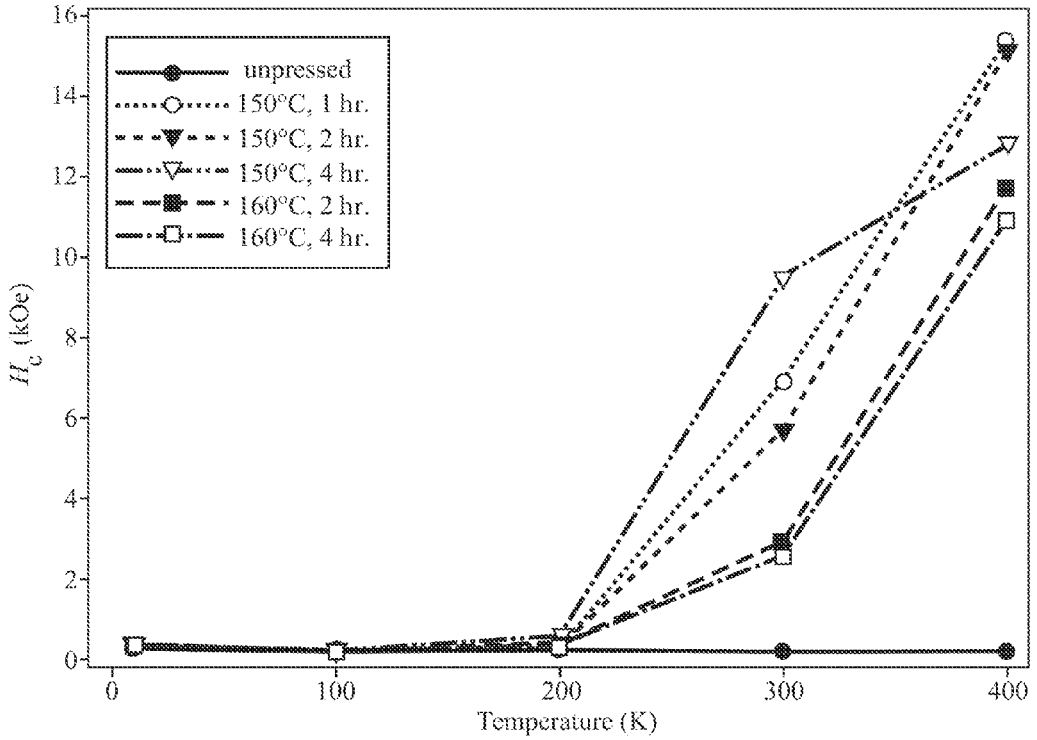
FIG. 4 is a graph of coercivity ($H_c$) as a function of temperature for samples including the MnBi nanoparticles of FIGS. 1 and 2 and bulk MnBi magnets formed by the disclosed process under varying conditions.

FIG. 4 plots coercivity as a function of analysis temperature for six different samples. The phrase "analysis temperature" in this context refers to the temperature at which the coercivity measurement was made, which is distinct from, and unrelated to, the "elevated temperature" of the process for making a bulk MnBi magnet.

The first sample, "unpressed", consists of MnBi nanoparticles of the type shown in FIGS. 1 and 2 which were not subjected to the process for making a bulk MnBi magnet. The other four samples are bulk magnets prepared by the process for making a bulk MnBi magnet, in which the elevated pressure was 40 MPa. As shown in FIG. 4, the elevated temperature was either 150° C. or 160° C. and the duration for which the simultaneous applying of elevated temperature and elevated pressure was performed was either 1, 2, or 4 hours.

It is first to be noted that all five bulk MnBi magnets in FIG. 4 show increasing coercivity with increasing temperature, a unique feature of LTP MnBi which further confirms its presence.

Without being bound by any particularly theory, it is believed that the step of applying elevated temperature and elevated pressure simultaneously to the synthesized MnBi nanoparticles may result in the development of the LTP crystal phase and the occurrence of plastic deformation which facilitates alignment of the magnetic moments of individual MnBi crystallites within the sample. If the duration or elevated temperature of the applying step is too large, it may result in a larger number of the magnetic moments aligning in opposite directions.

The present invention is further illustrated with respect to the following examples. It needs to be understood that these examples are provided to illustrate specific embodiments of the present invention and should not be construed as limiting the scope of the present invention.

Example 1. $Mn^0.Li(BH_4)_3.[CH_3(CH_2)_{10}CN]_3$ Synthesis 0.496 g of manganese powder, 0.592 g of lithium borohydride, 4.912 g of dodecane nitrile and 6 mL of toluene are added to a ball mill jar under argon. The mixture is milled at 300 rpm for 4 hours to produce the manganese-based ligated anionic elemental reagent complex (Mn-LAERC).

Example 2. Synthesis of MnBi Nanoparticles 12 g of the Mn-LAERC from Example 1 is added to 320 mL of toluene. Separately, a cationic bismuth solution is prepared by dissolving 112.984 g of bismuth neodecanoate in 333 mL of toluene. The Mn-LAERC solution and the cationic bismuth solution are combined, resulting in spontaneous formation of MnBi nanoparticles.

Example 3. Formation of Bulk MnBi Magnets

MnBi nanoparticles from Example 2 are hot pressed in a graphite punch and die at 40 MPa at temperatures up to 160° C., for up to 6 hours, under an argon atmosphere.

Example 3. Coercivity Measurement

M(H) curves are measured for the nanoparticles and bulk magnets of the type prepared in Examples 1 and 2, respectively, at analysis temperatures of 10, 100, 200, 300, and 400 K. At each temperature, coercivity of the sample is determined from the x-intercept where zero magnetization occurs. The results are shown in FIGS. 2-4.

The foregoing description relates to what are presently considered to be the most practical embodiments. It is to be understood, however, that the disclosure is not to be limited to these embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A method for synthesizing MnBi nanoparticles, the method comprising:

adding cationic bismuth to a complex according to a formula, $$Mn^0.X_y.L_z;$$

wherein $Mn^0$ is zero-valent manganese, X is a hydride molecule, L is a nitrile compound, y is an integral or fractional value greater than zero, and z is an integral or fractional value greater than zero;

thereby forming the MnBi nanoparticles.

2. The method as recited in claim 1, wherein the nitrile compound is undecyl cyanide.

3. The method as recited in claim 1, further comprising: contacting the complex with a free surfactant.

4. The method as recited in claim 3, wherein the adding and contacting steps are performed simultaneously.

5. The method as recited in claim 1, wherein the cationic bismuth is present as part of a bismuth salt, the bismuth salt having an acyl anion.

6. The method as recited in claim 5, wherein the acyl anion is neodecanoate.

7. The method as recited in claim 1, wherein the hydride molecule is a borohydride.

8. The method as recited in claim 1, wherein the hydride molecule is lithium borohydride.

9. A process for forming a bulk MnBi magnet, the process comprising:

applying elevated temperature and elevated pressure simultaneously to a sample of MnBi nanoparticles;

wherein the MnBi nanoparticles are synthesized by a method comprising:

adding cationic bismuth to a complex according to a formula, $$Mn^0.X_y.L_z;$$

wherein $Mn^0$ is zero-valent manganese, X is a hydride molecule, L is a nitrile compound, y is an integral or fractional value greater than zero, and z is an integral or fractional value greater than zero;

thereby forming MnBi nanoparticles.

10. The process as recited in claim 9, wherein the elevated temperature is within the range 100-200° C. and the elevated pressure is within the range 10-100 MPa.

11. The process as recited in claim 9, wherein the elevated temperature is about 150° C., the elevated pressure is about 40 MPa, and the applying step is performed for about 6 hours.

* * * * *